United States Patent [19]

Zuchtriegel

[11] Patent Number: 5,027,033

[45] Date of Patent: Jun. 25, 1991

[54] HIGH-EFFICIENCY FLUORESCENT LAMP OPERATING CIRCUIT

[75] Inventor: Anton Zuchtriegel, Taufkirchen, Fed. Rep. of Germany

[73] Assignee: Patent Treuhand Gesellschaft für elektrische Glühlampen mbH, Munich, Fed. Rep. of Germany

[21] Appl. No.: 462,783

[22] Filed: Jan. 10, 1990

[30] Foreign Application Priority Data

Jan. 16, 1989 [DE] Fed. Rep. of Germany ..... 3901111

[51] Int. Cl.[5] ..... H05B 37/02

[52] U.S. Cl. ..... 315/106; 315/107; 315/310; 315/DIG. 5

[58] Field of Search ..... 315/94, 105, 106, 107, 315/209 R, 225, 291, 307, 310, DIG. 5

[56] References Cited

U.S. PATENT DOCUMENTS 4,438,372 3/1984 Zuchtriegel ..... 315/224
4,647,817 3/1987 Fähnrich et al. ..... 315/104

FOREIGN PATENT DOCUMENTS 0259646 3/1988 European Pat. Off. .
2446579 8/1980 France .

*Primary Examiner*—Robert J. Pascal
*Attorney, Agent, or Firm*—Frishauf, Holtz, Goodman & Woodward

[57] ABSTRACT

To prevent long-time current flow through a positive temperature coefficient resistor (KL) included in the heater circuit of one or more fluorescent lamps (LP, LP1, LP2), a relay is connected in circuit with the PTC resistor (KL), which will respond when the voltage across the capacitor (C4) reaches the level of d-c voltage derived from a relay rectifier (GL) and coupled to the PTC resistor itself. The relay operates a switch contact (S) which interrupts the current flow through the PTC resistor; the flow through the relay is small in comparison with the current flow through the PTC resistor, thereby saving energy and decrease in the heat loading on the circuit structure.

15 Claims, 2 Drawing Sheets

HIGH-EFFICIENCY FLUORESCENT LAMP OPERATING CIRCUIT

Reference to related patents, the disclosures of which are hereby incorporated by reference, assigned to the assignee of the present application:

U.S. Pat. No. 4,647,817, Fahnrich et al

U.S. Pat. No. 4,438,372, Zuchtriegel.

The present invention relates to an operating circuit for one or more fluorescent lamps, and more particularly to such a circuit for a fluorescent lamp, or a plurality of serially connected fluorescent lamps, with auxiliary starting circuitry in which the starting circuitry is effectively disconnected when the lamps are in operation so that the overall efficiency of the lamp and its auxiliary circuit is improved.

BACKGROUND

U.S. Pat. No. 4,647,817, Fahnrich et al, the disclosure of which is hereby incorporated by reference, assigned to the assignee of the present application, describes a circuit for low-pressure fluorescent lamps in which the lamp is operated at high frequency, for example in the order of about 45 kHz. The lamp has an ignition circuit connected in parallel thereto and serially with the heater circuit, that is, with first and second electrodes, which includes a capacitor and a parallel connected positive temperature coefficient (PTC) resistor. After preheating of the electrodes by current flowing through the initially cold PTC resistor, a voltage rise will occur across a resonant capacitor and an inductance, causing ignition of the lamp.

When voltage is applied to the circuit, the PTC conductor is of low resistance and thus permits preheater current to flow through the electrodes of the lamp. This current heats the PTC resistor and, in accordance with a time-heater curve characteristic to the particular PTC resistor, it will assume a high resistance state. This, effectively, interrupts preheating of the electrodes and the lamp will fire or light due to the resonance circuit. The PTC resistor ensures adequate and rapid preheating of the electrodes and reliable ignition of the lamp.

In the circuit, as proposed in the referenced U.S. Pat. No. 4,647,817, it is a disadvantage that the PTC resistor, after-ignition and during the entire operation of the lamp, will carry current, and will be heated. Due to the long lifetime of fluorescent lamps, considerable energy will be wasted for heating the PTC resistor. Continued heating of the PTC resistor also applies an additional thermal load on the overall circuit, which may lead to failure of a circuit component, and especially to failure of the PTC resistor itself. Additionally, when fluorescent lamps are installed in locations requiring air-conditioning, the cooling effect of air-conditioning must additionally remove heat generated by the PTC resistor of the fluorescent lamp.

THE INVENTION

It is an object to provide a circuit arrangement which has all the advantages of the known circuit, namely rapid preheating and reliable ignition of the lamp, and in which however, after ignition of the lamp, or a group of lamps, typically two serially connected lamps, further heating of the positive temperature coefficient (PTC) resistor is inhibited, using a minimum number of circuit elements in a simple network configuration, which overall are so small that they can be readily integrated in the housing portion of an auxiliary or accessory circuit for the fluorescent lamp or group of fluorescent lamps.

Briefly, the starting circuit, in accordance with the present invention, is modified by providing an interrupt relay which has interrupter terminals, and a control element for controlling the relay. The interruptor terminals are connected serially with the PTC resistor to break the heater circuit connection between the electrodes and the PTC resistor when the lamp has fired. The control terminals of the relay are coupled to the PTC resistor itself and so connected that, upon low current flow through the PTC resistor, the relay will open.

The relay, in accordance with a feature of the invention, can be a miniature wound relay, in which the relay windings are so connected that when the electrodes of the fluorescent lamp or lamps have been appropriately preheated, the PTC resistor is disconnected.

It has been proposed to control relays which are intended to switch some time after a heater current is first energized by providing complex resistor-capacitor (R/C) networks, forming timing circuits. In accordance with a feature of the present invention, such additional timing circuits are not necessary since the PTC resistor itself, by changing from low resistance to high resistance, functions as a timing circuit for the control winding of the relay itself.

The relay may be a d-c relay and, to obtain the necessary d-c energy, the relay is preferably connected in parallel to the PTC resistor via a rectifier. A capacitor is connected, preferably, in circuit with the rectifier, which is used to set the relay switching voltage. A further capacitor, connected in parallel to the d-c output of the relay rectifier, is used as a filtering capacitor if the relay is of the type that cannot tolerate d-c supply with more than an insignificant hum or harmonic content.

For optimal ignition of a plurality of serially connected fluorescent lamps, all electrodes should be preheated. Those electrodes which are not connected to a common terminal between the high-frequency generating circuit thus must be additionally preheated. This is obtained, preferably, by an individual heating circuit which connects the electrodes of the respectively individual fluorescent lamps with each other, for example by connecting an additional secondary winding to these electrodes coupled to the resonance inductance of the resonant starting circuit. This additional heater circuit can be interrupted by the very same relay, for example by including a further relay terminal therewith. Thus, the heater circuit of everyone of the multiple fluorescent lamps can be individually controlled.

The switching terminals of the relay are preferably so arranged that they provide an ON connection when the relay is in quiescent or de-energized condition.

The PTC resistor, in accordance with a feature of the invention, thus is used with a multiple function; for one, it functions as a preheater element for the fluorescent lamps; in addition, however, and for another, it functions as a timer element for the relay, and to insure that the circuit of the present invention provides for optimum preheating time. This will result in rapid ignition of the lamp, free from glowing of the lamp before it fires, and consequently provides for high operating efficiency of the entire lamp-circuit combination. The relay remains energized during the operating time of the lamp or the lamps, that is, for the period of time that the high frequency supply is ON, that is, that the oscillator which provides the high frequency for network power is oscillating. The PTC resistor or cold conductor cools immediately after disconnection by the relay upon starting of the lamp. This ensures also that, if the lamp is externally disconnected only a few minutes after first connection, and then re-connected, appropriate preheating with subsequent reliable ignition will be obtained. Thus, the circuit is suitable not only for long-time lamp-ON operation, but also for highly intermittent lamp operation.

DRAWINGS

FIG. 1 illustrates, in part schematic form, the circuit in accordance with the present invention, to operate a single fluorescent lamp; and FIG. 2 illustrates the circuit of FIG. 1, arranged for operation of two or more fluorescent lamps, connected in series.

DETAILED DESCRIPTION

Figure 1:
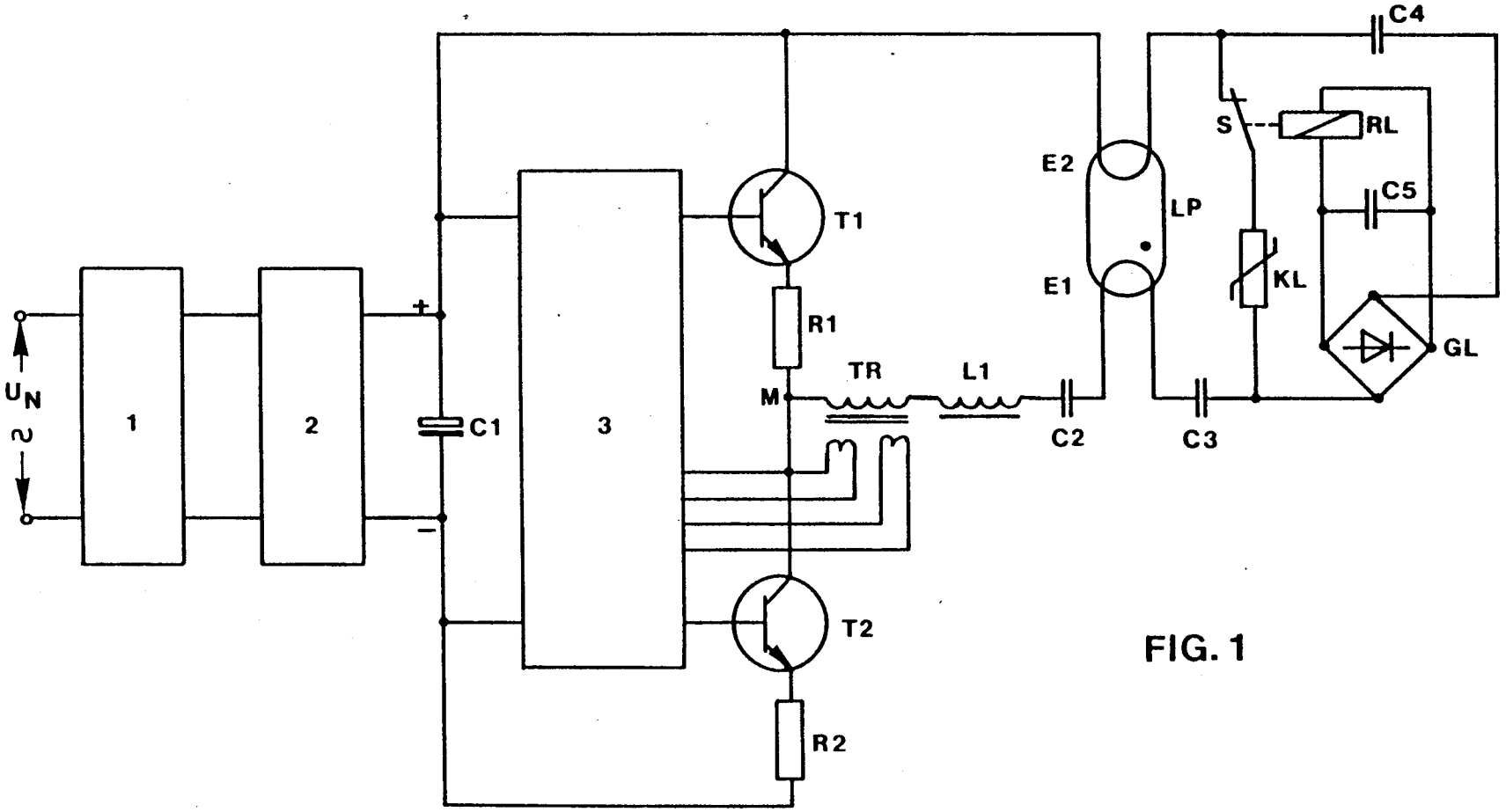

FIG. 1 shows the circuit in its basic form, to operate a fluorescent lamp LP. The circuit is adapted for connection to a source of alternating current $U_N$, for example of customary network voltage, such as 110 V, 60 Hz, or 220 V, 50 Hz. A high-frequency filter 1 is connected to the input terminals which have the voltage $U_N$ thereacross, which, in turn, is connected to a rectifier 2, the output of which is smoothed by a smoothing capacitor C1. The polarity of the rectifier output terminals is shown in FIG. 1 at + and −. The filtered smooth voltage is connected to a high-frequency generator formed by transistors T1 and T2, having suitable emitter resistors R1 and R2 and an inverter control circuit 3. Control voltage for the inverter control circuit 3, and for the transistors T1, T2, is derived from a ring core or toroidal core transformer TR, having a primary winding in the main current circuit for the lamp and two secondary windings, one for each of the transistors T1, T2. The transistors T1, T2 operate in push-pull, and are self-controlled or self-oscillating, as well known. All the circuit elements so far described are conventional and may be dimensioned in accordance with well known circuitry. Specifically, the inverter control circuit may be of any well known arrangement, for example as described in the literature referenced in U.S. Pat. No. 4,647,817, Fähnrich et al, the book "Elektronikschaltungen" (Electronic Circuitry) by Waltern Hirschmann, Berlin/Munich, Siemens Aktiengesellschaft, 1982, p. 148, or U.S. Pat. No. 4,438,372, Zuchtriegel.

The circuit further includes an ignition and starting circuit for the electrodes of the lamp. The ignition and starting circuit includes a series resonance circuit having a resonance inductance L1, a coupling capacitor C2, and a resonance capacitor C3. The resonance inductance L1 and the coupling capacitor C2 are serially connected with the toroidal transformer TR in the operating circuit between a common or center terminal M and the first electrode El of the lamp LP and the resonance capacitor C3 in the heater circuit of the lamp LP. The terminal M forms a common or center terminal between the transistors TR1 and TR2. The second electrode E2 of the lamp LP is connected with the positive terminal of the rectifier 2.

In accordance with the present invention, the switching element S of a relay RL is serially connected with the series circuit formed by the capacitor C3 and the PTC resistor KL. A relay rectifier GL has its a-c input terminals connected in parallel to the PTC resistor KL and the switch S. The d-c output terminals of the relay rectifier GL are connected to the relay winding of the relay RL, which controls operation of the switching element S. A capacitor C5 is connected across the d-c output terminals of the relay rectifier GL. A capacitor C4 is serially connected between the a-c input terminals of the relay rectifier GL and the respective connections across the PTC resistor KL and the switch element S.

Operation

Upon connection of the network-lamp system to a supply voltage $U_N$, preheater current will flow through the two electrodes E1, E2 and through the heater circuit including the PTC resistor KL. Initially, the PTC resistor KL is of low resistance value. Due to current flow therethrough, and after a predetermined preheating period for the lamp electrodes, the PTC resistor KL changes over to high resistance value. This permits charging of the capacitor C4 until the d-c output voltage at the relay rectifier GL has reached a predetermined switching voltage value. When this switching voltage value is reached, the relay will respond and the switch S will open, which disconnects the PTC resistor KL. At the same time, the lamp LP will fire and light. The PTC resistor, during the entire operating time of the lamp LP will remain out-of-circuit, that is, disconnected, since the relay RL due to continuous excitation, holds the switch S in OFF or open state. Upon disconnection of network voltage, the relay will drop out and the current connection by the switch S will be reestablished. Upon reconnection to network voltage, the cycle will repeat.

The holding current through the relay RL is negligible with respect to current flow through the PTC resistor KL.

As an example, and for a 58 W fluorescent lamp connected to a supply voltage $U_N$ of 220 V, 50 Hz, the following components are suitable:

| | |
|---|---|
| C1 | 10 F/450 V− |
| T1, T2 | MJE 13007 |
| R1, R2 | 0.39Ω |
| TR | toroidal core (10 × 6 × 4) primary 9 turns two secondaries of 3 turns each |
| L1 | EF25, 1,4 mH |
| C2 | 100 nF/250 V~ |
| KL | PTC resistor 65Ω (1.5 A) |
| GL | B 250, C 800 |
| RL | 24 V DC/1400Ω, switch terminal 2 A/250 V~ |
| C3 | 2.2 nF/60 V− |
| C4 | 0.47 nF/1000 V− |
| C5 | 0.1 nF/100 V− |

Figure 2:
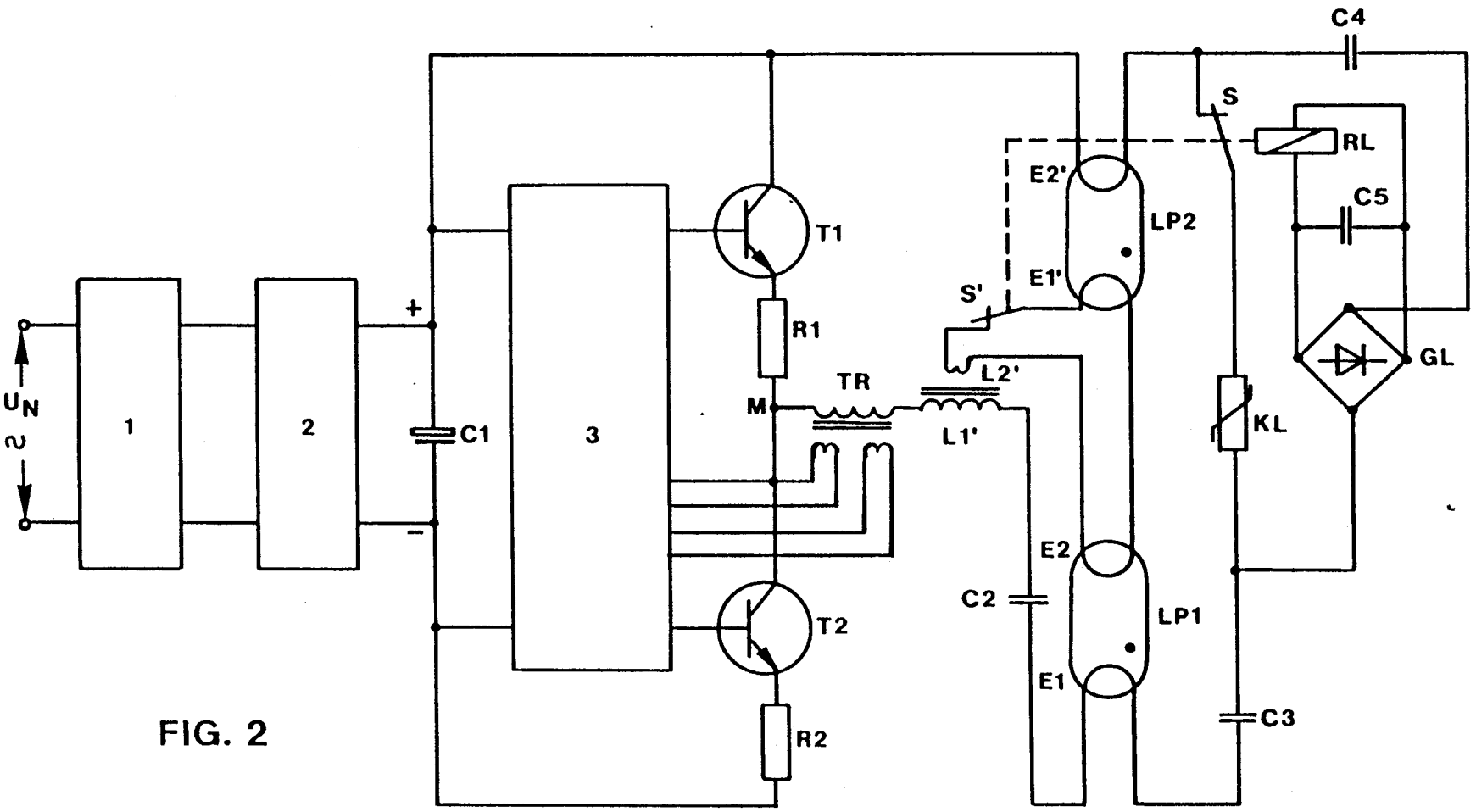

If two or more lamps are to be operated from the circuit, it is desirable to disconnect the heater circuit for each one of the lamps. Referring now to FIG. 2, in which the basic circuit for the lamps is the same. The first electrode E1 of the first lamp LP1 is connected to the center or common junction terminal M. The second electrode E2' of the second lamp LP2 is connected to the positive terminal of the rectifier 2.

The two center electrodes E2 and E1' of the lamp LP1 and LP2, respectively, are interconnected in a separate heating circuit, supplied by current through a secondary winding L2' coupled to the resonance inductance L1'. This heater circuit is interrupted, separately, by a switch S', coupled to and operated by the relay RL. The relay RL, controlled to operation by the combination of the PTC resistor KL and the capacitor C4, and connected to the relay rectifier GL as before, permits interrupting the preheater current of all the electrodes at the same time, when the preheating necessary for the firing of the lamp has been accomplished.

Various changes and modifications may be made, and any features described herein may be used with any of the others, within the scope of the inventive concept. .

I claim:

1. Operating circuit for at least one low-pressure discharge lamp (LP), particularly a fluorescent lamp having first and second heatable electrodes (E1, E2) connected in a heater circuit, said operating circuit having a rectifier (2) having d-c terminals;

a smoothing capacitor (C1) connected across the d-c terminals of the rectifier;

an oscillator circuit including two semiconductor switches (T1, T2) connected for alternating conduction and blocking and defining a common junction (M), and a feedback circuit (3) for said semiconductor switches to cause the oscillator circuit to oscillate;

first circuit means connecting the first electrode (E1) of said at least one lamp to said common junction (M);

second circuit means connecting the second electrode (E2) of said at least one lamp with one of the d-c terminals of the rectifier (2);

a series resonance circuit including a resonance inductance (L1, L1'), a resonance capacitor (C3) and coupling capacitor (C2) coupling the series resonance circuit to the electrodes of the lamp, the resonance inductance (L1) and the coupling capacitor (C2) being connected serially in said first circuit means between said common junction (M) and said first electrode of the at least one lamp;

third circuit means including a positive temperature coefficient resistor (KL) connecting said positive temperature coefficient resistor and said resonance capacitor (C3) serially from the first electrode (E1) to the second electrode (E2) of said at least one lamp;

and comprising, in accordance with the invention, interrupt relay means (RL; S) including an interrupt means (S) add a control means (RL) for said interrupt means, said interrupt means (S) being connected serially in said third circuit means to break the heater circuit connection between said electrodes (E1, E2) of the at least one lamp; and fourth circuit means (C4, GL, C5) coupled to the positive temperature coefficient resistor (KL) and connected to said control means (RL) for the interrupt means (S), to control said control means (RL) for the interrupt means to effectively open the interrupt means in dependence on the resistance of said positive temperature coefficient resistor (KL).

2. The circuit of claim 1, wherein said relay means comprises a wound wire relay, said control means comprises the solenoid coil of said relay and said interrupt means comprises switch means.

3. The circuit of claim 1, further including a relay rectifier (GL), said relay rectifier having a-c input terminals connected in parallel to said positive temperature coefficient resistor (KL) and the interrupt means (S) and having d-c output terminals connected to said control means (RL) for said interrupt means (S).

4. The circuit of claim 2, further including a relay rectifier (GL), said relay rectifier having a-c input terminals connected in parallel to said positive temperature coefficient resistor (KL) and the interrupt means (S) and having d-c output terminals connected to the solenoid coil of the relay.

5. The circuit of claim 1 , further including a capacitor (C4) included in said fourth circuit means.

6. The circuit of claim 4, wherein said fourth circuit means includes a capacitor (C4) connected between one of the a-c terminals of the positive temperature coefficient resistor (KL) and an a-c terminal of said relay rectifier (GL).

7. The circuit of claim 1, further including a smoothing capacitor (C5) connected across said control means (RL).

8. The circuit of claim 4, further including a smoothing capacitor (C5) connected across the output of said relay rectifier (GL).

9. Operating circuit for at least two low-pressure discharge lamps (LP1, LP2), particularly fluorescent lamps, each having first and second electrodes (E1, E2, E1', E2');

a rectifier (2) having d-c output terminals;

a smoothing capacitor (C1) connected across said rectifier output terminals;

an oscillator circuit including two semiconductor switches (T1, T2) connected for alternate conduction and blocking, and defining a common junction (M);

a feedback circuit (3) for said semiconductor switches to cause said oscillator circuit to oscillate;

first circuit means connecting the first electrode (E1) of a first one (LP1) of said at least two lamps to the common junction;

second circuit means connecting the second electrode (E2') of the last one (LP2) of said at least two lamps with one of the d-c terminals of the rectifier (2);

a series resonance circuit including a resonance inductance (L1'), a resonance capacitor (C3) and a coupling capacitor (C2), said resonance inductance (L1') and the coupling capacitor (C2) being connected serially in said first circuit means between said common junction and said first electrode of said first one of the plurality of lamps (L1');

third circuit means including a positive temperature coefficient resistor (KL) connecting said positive temperature coefficient resistor and said resonance capacitor (C3) serially from the first electrode (E1) to the second of the last one (LP2) of said plurality of lamps; and comprising, in accordance with the invention, interrupt relay means (RL, S) including an interrupt means (S) and a control means (RL) for said interrupt means, said interrupt means (S) being connected serially in said third circuit means to effectively interrupt the heater circuit connection between the first electrode (E1) of the first one of said plurality of lamps and the second electrode (E2') of the last one (LP2) of said plurality of lamps; and fourth circuit means coupled to the positive temperature coefficient resistor and connected to said control means (RL) for the interrupt means.

10. The circuit of claim 9, further including a series heater connection between the second electrode (E2) of the first one of said plurality of lamps and a first electrode (E1') of a further one of said plurality of lamps;

and including further interrupt means (S') controlled by said control means (RL) and operated in synchronism with said interrupt means (S) for interrupting the further heater circuit interconnecting the second electrode of the first lamp and the first electrode of a further lamp.

11. The circuit claim 9, wherein said further heater circuit includes a winding (L2') inductively coupled with said resonance inductance (L1') for supplying heater energy to said second electrode (E2) of the first one (LP1) of said lamps and the first electrode (E1') of the further lamp (LP2).

12. The circuit of claim 9, wherein said relay means comprises a wound wire relay, said control means comprises the solenoid coil of said relay and said interrupt means comprises switch means.

13. The circuit of claim 12, further including a relay rectifier (GL), said relay rectifier having a-c input terminals connected in parallel to said positive temperature coefficient resistor (KL) and the interrupt means (S) and having d-c output terminals connected to the solenoid coil of the relay.

14. The circuit of claim 13, wherein said fourth circuit means includes a capacitor (C4) connected between one of the a-c terminals of the positive temperature coefficient resistor (KL) and an a-c terminal of said relay rectifier (GL).

15. The circuit of claim 13, further including a smoothing capacitor (C5) connected across the output of said relay rectifier (GL).

* * * * *